US011326345B2

(12) United States Patent
Kim et al.

(10) Patent No.: US 11,326,345 B2
(45) **Date of Patent: *May 10, 2022**

(54) HOLLOW COMPOSITE BEAM USING DUAL-WEB AND CONSTRUCTION METHOD THEREOF

(71) Applicant: KOREA INSTITUTE OF CIVIL ENGINEERING AND BUILDING TECHNOLOGY, Gyeonggi-do (KR)

(72) Inventors: Heung Youl Kim, Gyeonggi-do (KR); Bum Yeon Cho, Seoul (KR)

(73) Assignee: KOREA INSTITUTE OF CIVIL ENGINEERING AND BUILDING TECHNOLOGY, Gyeonggi-do (KR)

( * ) Notice: Subject to any disclaimer, the term of this patent is extended or adjusted under 35 U.S.C. 154(b) by 70 days.

This patent is subject to a terminal disclaimer.

(21) Appl. No.: 16/691,529

(22) Filed: Nov. 21, 2019

(65) Prior Publication Data

US 2020/0165824 A1 May 28, 2020

(30) Foreign Application Priority Data

Nov. 23, 2018 (KR) ..... 10-2018-0145897

(51) Int. Cl.

| | |
|---|---|
| ***E04C 3/06*** | (2006.01) |
| ***E04C 3/10*** | (2006.01) |
| ***E04C 3/293*** | (2006.01) |
| *E04B 5/29* | (2006.01) |
| *E04C 5/12* | (2006.01) |

(52) U.S. Cl.

CPC ..... *E04C 3/06* (2013.01); *E04C 3/293* (2013.01); *E04B 5/29* (2013.01); *E04C 3/10* (2013.01); *E04C 5/122* (2013.01)

(58) Field of Classification Search

CPC . E04C 3/06; E04C 3/293; E04C 5/122; E04C 5/125; E04C 5/10; E04C 3/10; E04C 3/02; E04B 5/29; E04B 5/40

See application file for complete search history.

(56) References Cited

U.S. PATENT DOCUMENTS

| | | | | |
|---|---|---|---|---|
| 4,115,971 A | | 9/1978 | Varga | |
| 4,607,470 A | * | 8/1986 | Ecker | E04B 5/29 52/223.12 |
| 5,493,828 A | * | 2/1996 | Rogowsky | E04C 5/122 52/223.13 |
| 7,963,078 B1 | * | 6/2011 | Sorkin | E04C 5/122 52/223.13 |
| 9,062,457 B2 | * | 6/2015 | Gilling | E02D 5/74 |

(Continued)

FOREIGN PATENT DOCUMENTS

| | | |
|---|---|---|
| KR | 20090087678 | 8/2009 |
| KR | 101038291 | 5/2011 |
| KR | 101243989 | 3/2013 |

*Primary Examiner* — Phi D A

(74) *Attorney, Agent, or Firm* — JCIPRNET

(57) ABSTRACT

Provided are a hollow composite beam using a dual-web and a construction method thereof. The hollow composite beam using a dual-web can secure space efficiency using a tendon installed in an internal space of a dual-web and can efficiently adjust a tensioning force using the tendon anchored by an anchoring wedge and a separable bolt, wherein the dual-web is formed as a web of a steel beam having a bottom flange on which a deck plate is supported.

8 Claims, 7 Drawing Sheets

(56) References Cited

U.S. PATENT DOCUMENTS

| | | | | |
|---|---|---|---|---|
| 2004/0040233 | A1* | 3/2004 | Park | E04C 5/08 52/223.8 |
| 2009/0178352 | A1* | 7/2009 | Huff | E04C 3/10 52/223.8 |
| 2011/0247297 | A1* | 10/2011 | Bae | E04C 3/291 52/838 |
| 2016/0032580 | A1* | 2/2016 | Rahimzadeh | E04B 5/19 52/236.9 |
| 2016/0222593 | A1* | 8/2016 | Jalayer | A63G 7/00 |
| 2018/0080227 | A1* | 3/2018 | Peltonen | E04B 5/29 |
| 2018/0195306 | A1* | 7/2018 | Wiles | E04H 12/24 |
| 2019/0226927 | A1* | 7/2019 | Cook | E04G 21/121 |
| 2019/0292785 | A1* | 9/2019 | Bottomley | E04C 5/10 |

* cited by examiner

HOLLOW COMPOSITE BEAM USING DUAL-WEB AND CONSTRUCTION METHOD THEREOF

CROSS-REFERENCE TO RELATED APPLICATION

This application claims priority to and the benefit of Korean Patent Application No. 10-2018-0145897, filed on Nov. 23, 2018, the disclosure of which is incorporated herein by reference in its entirety.

BACKGROUND

Field of the Invention

The present invention relates to a hollow composite beam using a dual-web and a construction method therefor, and more specifically, to a hollow composite beam using a dual-web which allows space efficiency to be secured using a tendon installed in an internal space of a dual-web and a tensioning force to be efficiently adjusted using the tendon anchored by an anchoring wedge and a separable bolt, wherein the dual-web is formed as a web of a steel beam having a bottom flange on which a deck plate is supported, and a construction method thereof.

Description of Related Art

FIG. 1A is a constructional cross-sectional view illustrating a conventional hollow steel beam 51 on which deck plates 52 are installed.

That is, a bottom flange of the hollow steel beam 51 is formed in the form of a hollow box to allow the deck plates 52 to be supported on upper surfaces of two lateral portions of the bottom flange, slab concrete 53 is poured on upper surfaces of the deck plates 52, and thus it can be confirmed that the hollow steel beam 51, the deck plates 52, and the slab concrete 53 are combined and integrally moved.

FIGS. 1B and 1C are configuration perspective views illustrating conventional hollow rectangular steel beams 61, 62, and 63 in which anchoring parts 64 and 65 are formed.

That is, in the hollow rectangular steel beams 61, 62, and 63, two vertical plates 61 are spaced apart from each other by an internal horizontal supporting plate 63 to have a rectangular cross-section, and a top flange 62 is formed on upper surfaces of the two vertical plates 61.

In this case, the anchoring parts 64 and 65 are installed below end portions of the two vertical plates 61, and the tendon 64 is disposed in an internal space between the two vertical plates 61 and is tensed by the anchoring unit 65 set below the two vertical plates 61 and anchored, and thus it can be confirmed that a prestress is introduced to the hollow rectangular steel beams 61, 62, and 63.

Therefore, it can be confirmed that the steel beam used for a building may be formed to have an I-shaped or rectangular cross-section and the tendon 64 is positioned in the steel beam and tensed and anchored on end portions of the steel beam.

FIG. 1D is a view illustrating an installation state of a bolt-type anchoring part in a method of laterally reinforcing a column and increasing fire resistance performance that is filed by an applicant and registered and that is able to uniformly introduce a prestress.

The bolt-type anchoring part includes: an anchoring nut 41 that allows an anchoring bolt 40 inserted into an anchorage hole 11 formed in a module material 10 to be fastened and fixed to the module material 10; an anchoring bolt 40 including a bolt part and a head part, wherein the bolt part has a screw part 42 formed on an outer circumferential surface thereof and insertion-fastened to the anchorage hole 11, and the head part has a wedge groove 42*a* formed therein so that a anchorage wedge 45 is insertion-anchored therein; a deformation clip 43 including a ring-shaped ring part 43*a* and two flange parts 43*b*, wherein the ring-shaped ring part 43*a* allows a wire rope 30 to pass therethrough and has a ring shape to allow the wedge to be deformed due to the prestress while being insertion-anchored, and the two flange parts 43*b* laterally extend to two lateral sides of the ring-shaped ring part; a clip nut 44 that is a nut having a larger diameter than the bolt part of the anchoring bolt and includes a clip groove 44*a* and a through hole 44*b*, wherein the clip groove 44*a* is formed at a portion that is in contact with the bolt part so that the deformation clip 43 is accommodated therein, and a through hole 44*b* is formed in a central portion of the clip groove so that the wedge passes therethrough; and the anchorage wedge 45 that allows the wire rope 30 to pass through the through hole 44*b* of the clip nut, the ring-shaped ring part 43*a* of the deformation clip, and the wedge groove 42*a* formed in the bolt part of the anchorage bolt, and thus the amount of initial prestress introduced due to anchorage of the wedge can be confirmed according to deformation of the clip nut.

In this case, it can be confirmed that the anchorage wedge 45 includes a plurality of pieces that surround and hold the tendon, and generally, since the anchorage wedge 45 is inserted into and pressed against the anchorage hole formed in the anchoring unit in a tapered manner so that the tendon including the wire rope is anchored in the anchoring unit, when an anchorage state is released, the wedge is separable from the anchoring part.

However, as shown in FIG. 1A, when an artificial pullout operation is required, the safety of a structure including an anchoring unit cannot be secured, and a pullout operation space and a pullout device are required, and thus the conventional hollow steel beam is not easy to use in a site and improvement is required.

Prior Patent Document

Patent Document (Patent Document 0001) Korean Registered Patent No. 10-1038291 (Title of Invention: Slim Floor-Type Steel Beam and Composite Beam Using the Same, Published on May 31, 2011)

(Patent Document 0002) Korean Laid-open Patent Application No. 10-2009-0087678 (Title of Invention: Folded Steel Plate Beam for Reinforcing Tensile Strength and Steel-Concrete Composite Structure Using the Same, Published on Aug. 18, 2009)

(Patent Document 0003) Korean Registered Patent No. 10-1243989 (Title of Invention: Lightweight Steel Frame and Arch-Shaped House Structure Using the Same, Published on Aug. 24, 2012)

SUMMARY

According to an aspect of the present invention, there is provided a hollow composite beam using a dual-web which includes a dual-web formed by two inclined plates to form an internal space (S) between a lower surface of a top flange of a steel beam and an upper surface of a bottom flange thereof, wherein the two inclined plates continuously extend in a length direction of the hollow composite beam, and an anchoring unit configured to tense two end portions of a tendon, which is disposed to extend in the internal space (S) in the length direction of the hollow composite beam, using the two inclined plates and anchor the two end portions of the tendon using a tendon anchoring part.

The anchoring unit may include an internal groove formed to communicate with an anchorage hole in which an anchoring wedge is anchored, wherein the anchoring wedge is anchored in the anchorage hole and includes a bolt hole that is a horizontal hole extending to be externally exposed through an upper surface and an inside of the anchoring wedge and a fastening part for example formed in a middle of the bolt hole.

The hollow composite beam may further include a separable bolt including a bolt-body part inserted into the bolt hole formed in the anchoring wedge so that a portion at which a front end part is formed is exposed to the anchorage groove, which is a rod member having a fastener formed in a middle of the rod member and fastened with the fastening part of the anchoring wedge to move in a screwing manner while rotating, wherein the separable bolt inserted into the anchoring wedge rotates to allow the anchoring wedge to be separable from the anchorage hole.

The tendon anchoring part may include two anchoring vertical plates that extend downward from a central lower surface (A) of the top flange and are spaced apart from each other so that two end portions thereof extend to end surfaces of the two inclined plates and are hung, and a tendon supporting plate formed on a lower portion between the two anchoring vertical plates so that the tendon does not come out downward from therebetween, wherein the tendon is positioned between the two anchoring vertical plates.

The tendon anchoring part may further include an end surface-transverse fixing element having a central portion fastened with the two anchoring vertical plates between which the tendon is positioned and two end portions are also fastened with the two inclined plates so that the tendon is stably settable.

According to another aspect of the present invention, there is provided a method of constructing a hollow composite beam using a dual-web which includes (a) constructing a hollow composite beam which includes a dual-web formed by two inclined plates to form an internal space (S) between a lower surface of a top flange of a steel beam and an upper surface of a bottom flange thereof, wherein the two inclined plates continuously extend in a length direction of the hollow composite beam, and an anchoring unit configured to tense two end portions of a tendon, which is disposed to extend in the internal space (S) in the length direction of the hollow composite beam, using the two inclined plates and anchor the two end portions of the tendon using a tendon anchoring part, and (b) installing a plurality of deck plates (D) on the bottom flange of the hollow composite beam, arranging slab reinforcement bars, and pouring slab concrete thereon to construct a composite floor system.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DESCRIPTION OF THE EMBODIMENTS

Figure 1A:
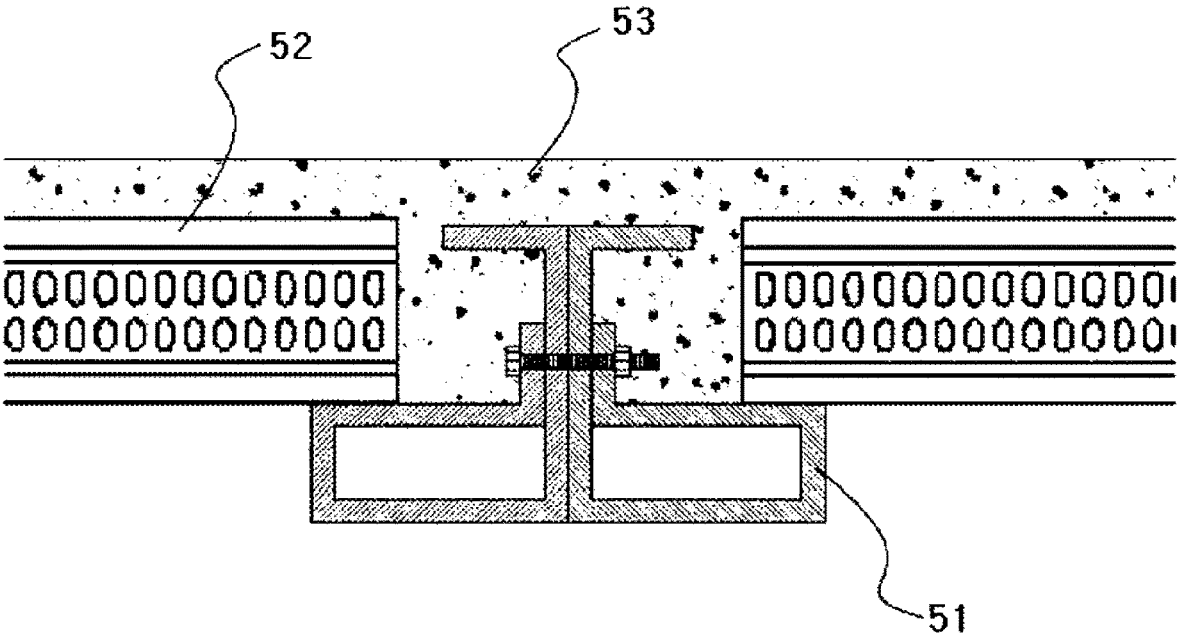
FIGS. 1A, 1B and 1C are a cross-sectional view and configuration perspective views illustrating a conventional steel beam.
Figure 1C:
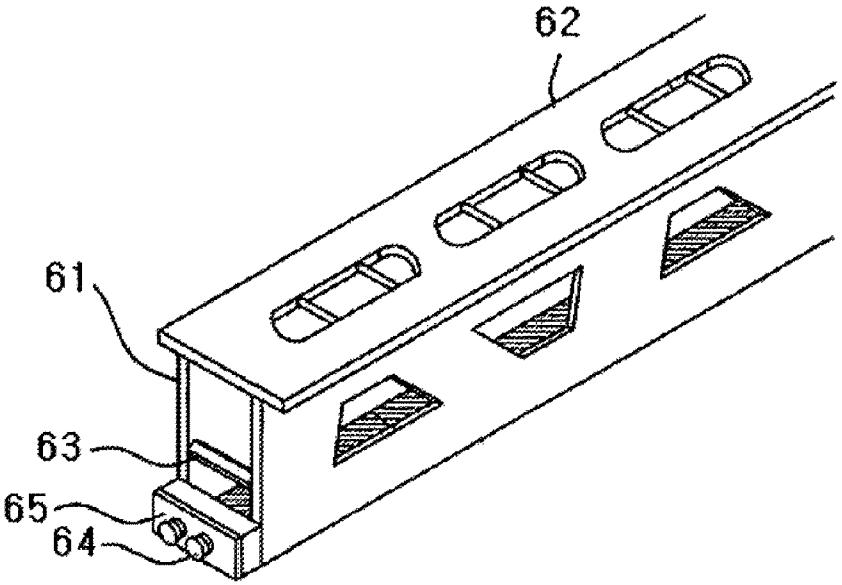
Figure 1B:
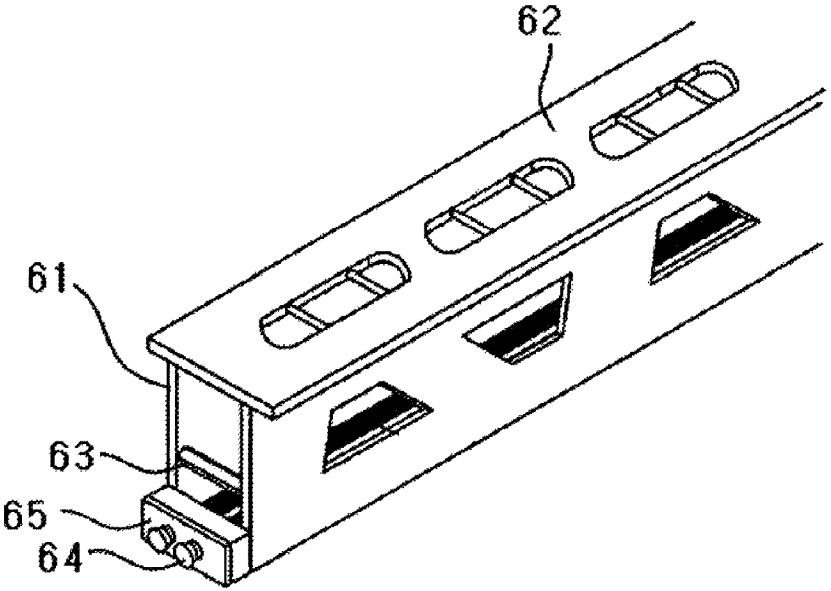
Figure 1D:
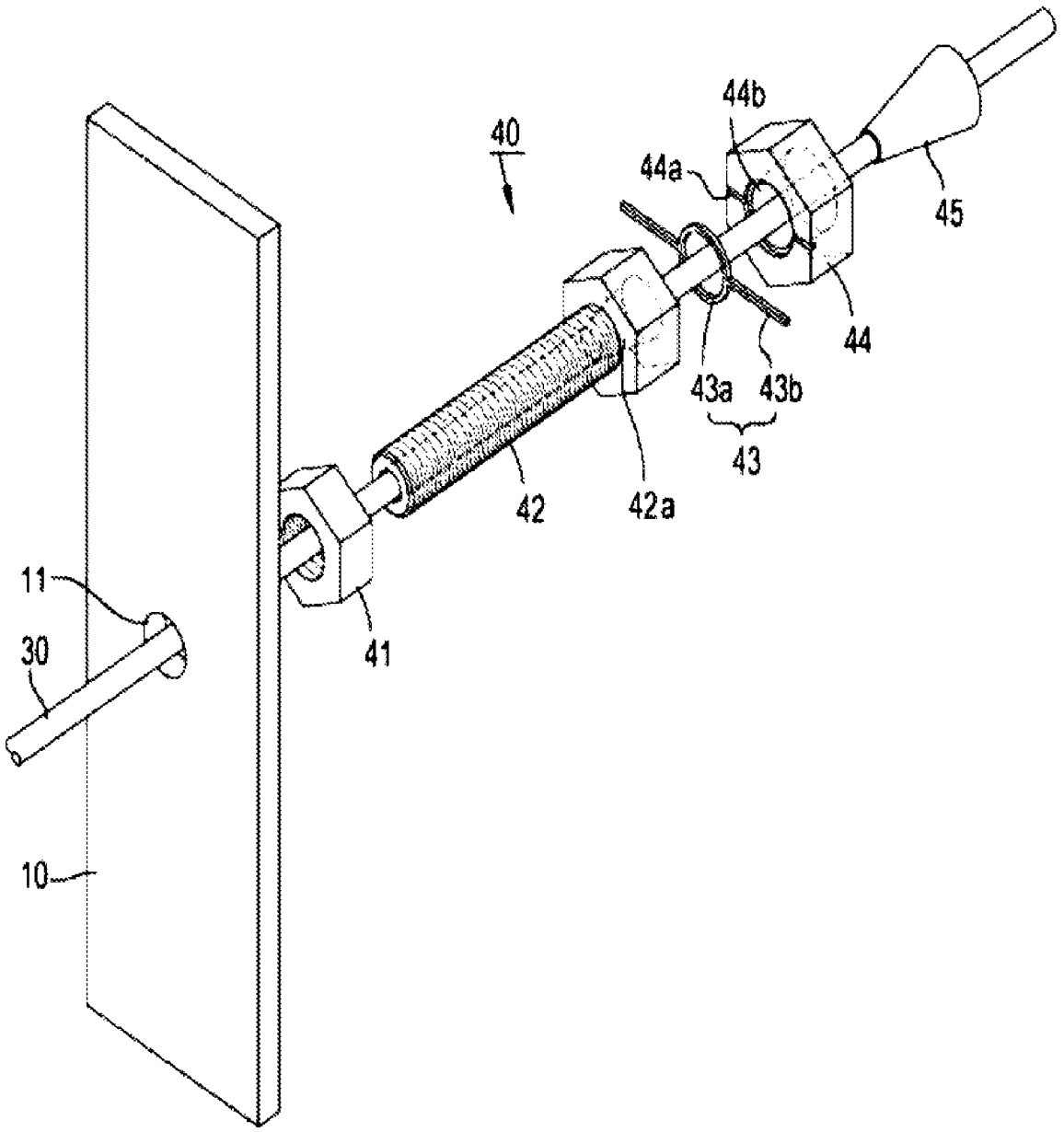
FIG. 1D is a view illustrating an installation state of a bolt-type anchoring part in a method of laterally reinforcing a column and increasing fire resistance performance that is filed by an applicant and registered and that is able to constantly introduce a prestress.

Hereinafter, embodiments that are easily performed by those skilled in the art will be described in detail with reference to the accompanying drawings. However, the embodiments of the present invention may be implemented in several different forms and are not limited to embodiments described herein. In addition, parts irrelevant to description will be omitted in the drawings to clearly explain the embodiments of the present invention. Similar parts are denoted by similar reference numerals throughout this specification.

Throughout the specification, when a portion "includes" an element, the portion may include the element or another element may be further included therein unless otherwise described.

[Hollow Composite Beam 500 Using a Dual-Web of the Present Invention]

Figure 2A:
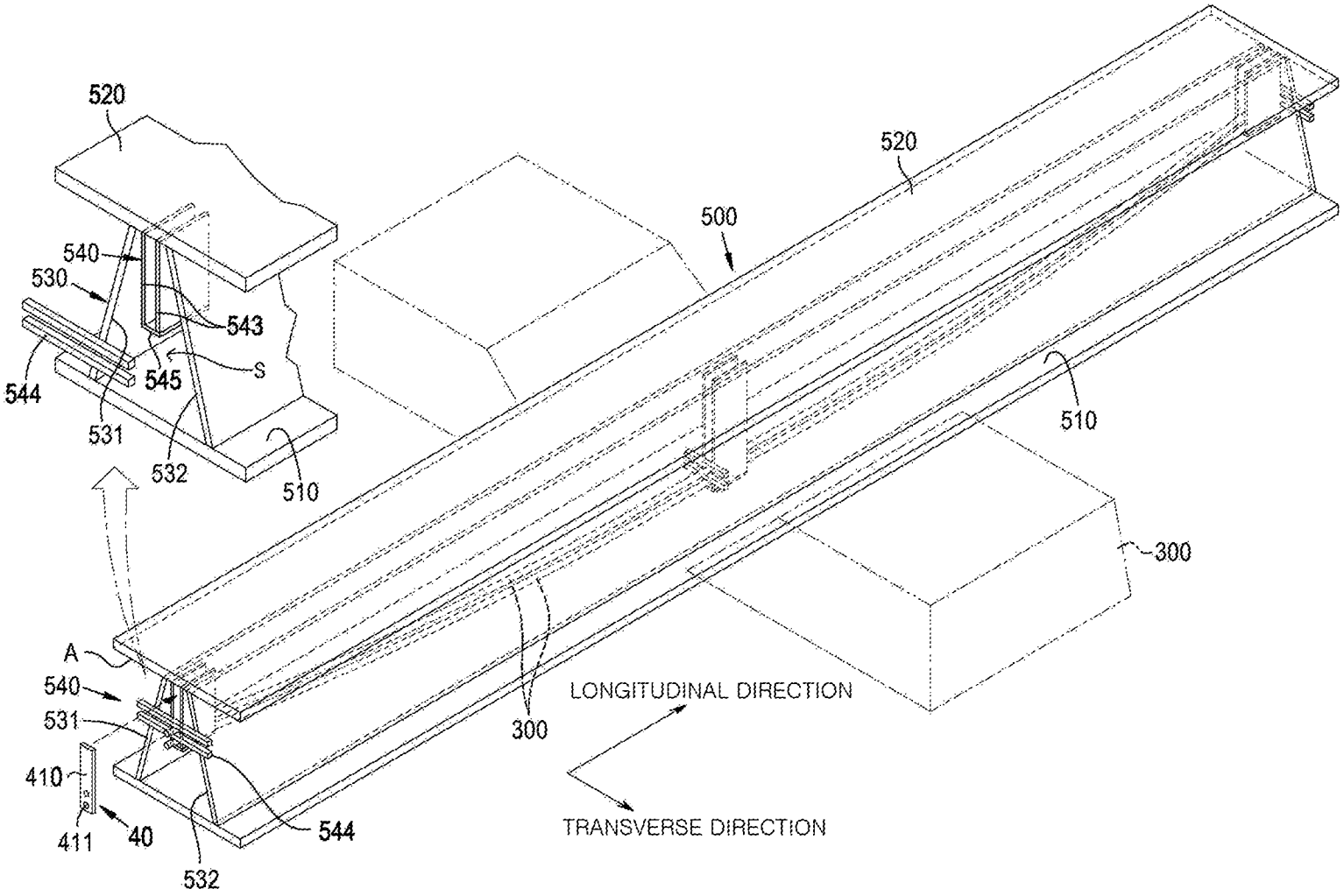
FIGS. 2A to 2E are configuration perspective views illustrating a tendon anchoring part having a separable bolt and a hollow composite beam using a dual-web according to the present invention.

FIG. 2A is a configuration perspective view illustrating the hollow composite beam 500 using a dual-web of the present invention.

As shown in FIG. 2A, it may be confirmed that the hollow composite beam 500 includes a steel beam including a bottom flange 510, a top flange 520, and a dual-web 530 and a tendon anchoring part 540.

Figure 3:
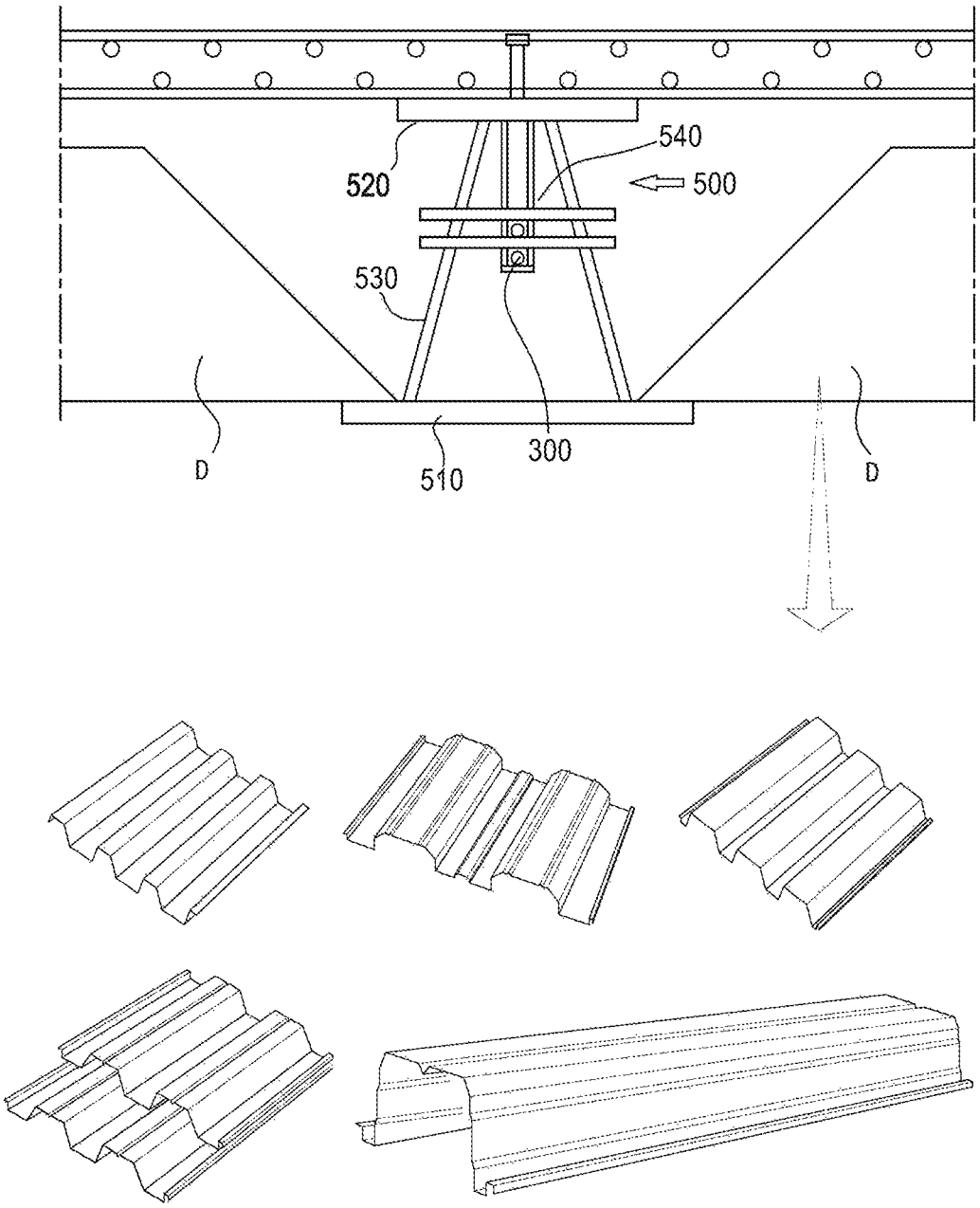
FIG. 3 is a view illustrating a method of constructing a hollow composite beam using a dual-web of the present invention.

Referring to FIG. 3, the hollow composite beam 500 is a composite floor system of a building and is a steel beam member installed between column structures to support a deck plate D. Therefore, slab concrete is poured on an upper portion of the hollow composite beam 500 to be combined and serves as a hollow composite beam with a predetermined cross-sectional height.

Therefore, it may be confirmed that the bottom flange 510 is formed as a steel plate member that continuously extends in a length direction (longitudinal direction) of the hollow composite beam 500.

It may be confirmed that the top flange 520 is also formed as a steel plate member that continuously extends in a length direction of the hollow composite beam 500, and it may be confirmed that a width in a transverse direction of the top flange extends more than that of the bottom flange, and thus resistance performance for a bending moment can be secured sufficiently.

The dual-web 530 is formed by two inclined plates 531 and 532 between a lower surface of the top flange 520 and an upper surface of the bottom flange 510, and the two inclined plates 531 and 532 spaced apart from each other continuously extend in a length direction of the hollow composite beam 500.

Therefore, the dual-web 530 serves to form an internal space S between the two inclined plates spaced apart from each other in a transverse direction and allows concrete to be poured while sliding downward when slab concrete is poured. The two inclined plates 531 and 532 are disposed so that a width in a transverse direction increases in a direction from the top flange to the bottom flange, and a lower portion of an internal space S is larger than an upper portion thereof, and thus a space, in which a tendon anchoring part 540 to be described below is set, can be secured.

Further, when the inclined plates 531 and 532 extend downward so that the width in a transverse direction increases in a downward direction, the inclined plates 531 and 532 may be formed to have resistance performance for a tensile stress below a neutral axis and a structural cross-section that is very appropriate for securing bending strength as compared to the dual-web having vertical plates spaced apart from each other.

The tendon anchoring part 540 includes anchoring units 400 that allow two end portions of the tendon 300, which is disposed in the internal space S between the two inclined plates 531 and 532 and extends in a length direction of the hollow composite beam 500, to be tensed and anchored using the two inclined plates 531 and 532.

In this case, since the anchoring units 400 are installed using the two inclined plates 531 and 532, anchoring vertical plates 543, end surface-transverse fixing elements 544, and a tendon supporting plate 545 are used in particular.

That is, it may be confirmed that the two anchoring vertical plates 543 extend from a lower surface A of the central portion of the top flange 520 to be spaced apart from each other in a transverse direction so that the two end portions of the tendon 300 extend to end surfaces of the two inclined plates 531 and 532 and are hung.

Therefore, the tendon 300 is positioned between the two anchoring vertical plates 543, and the tendon supporting plate 545 is formed on a lower portion between the two anchoring vertical plates 543 so that the tendon 300 does not come out downward from therebetween.

The two anchoring vertical plates 543 are formed on the two end portions of the tendon and may be installed to be spaced apart from each other in the length direction at different downward extension lengths so that the tendon 300 is maintained in an arc shape.

Therefore, the tendon 300 may be stably hung and installed in the internal space S in the length direction.

Figure 2B:
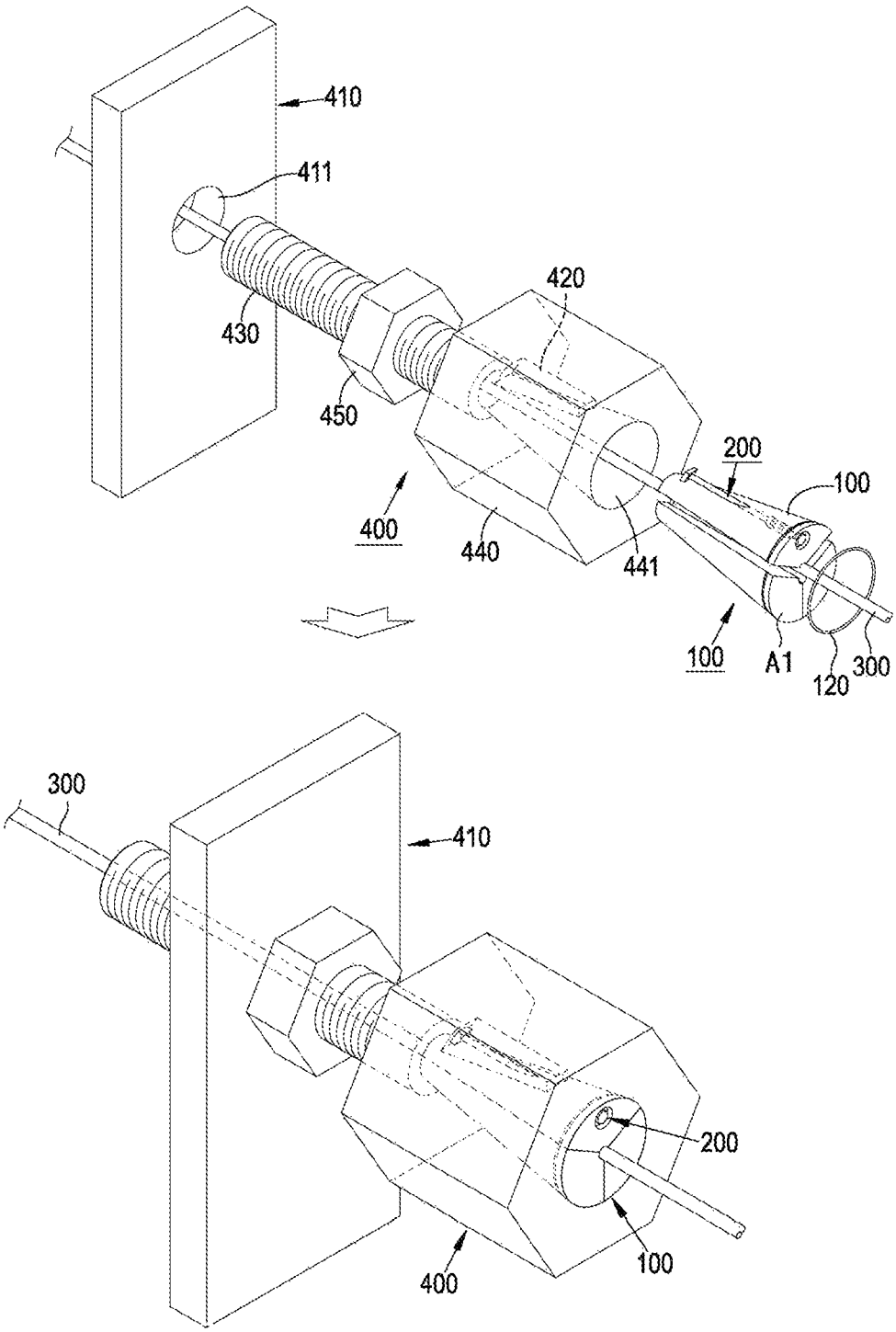

Further, referring to FIG. 2B, since end portions of the tendon 300 are tensed and anchored by head parts 440 of the anchoring units 400 but are not in a supported state, the hollow composite beam 500 further includes the end surface-transverse fixing element 544 having a central portion fastened to the two anchoring vertical plates 543 between which the tendon 300 is positioned and two end portions fastened to the two inclined plates 531 and 532 so as to serve to stably set the tendon 300.

Therefore, although the two inclined plates 531 and 532 integrate with the top flange and the bottom flange, and the two anchoring vertical plates 543 vertically extend to the internal space S, the tendon 300 can be stably positioned and supported by the end surface-transverse fixing element 544.

Therefore, the anchoring units 400 and an anchoring wedge 100 serve to tense and anchor the tendon 300.

For example, the anchoring units 400 are set on the end surfaces of the two inclined plates 531 and 532, and the tendon 300 disposed to pass through the anchoring unit 400 is tensed and anchored by the anchoring wedge 100 and a separable bolt 200.

Therefore, an introduced prestress may be vertically and laterally distributed and effectively introduced to the hollow composite beam 500 by the end surface-transverse fixing element 544 and the two inclined plates 531 and 532.

[Anchoring Wedge 100 of the Present Invention]

As shown in FIGS. 2B, 2C, 2D and 2E, the anchoring wedge 100, which is inserted into and anchored in an anchorage hole 441 that is tapered and passes through the head part 440 of the anchoring unit 400, may be formed such that a plurality of wedge pieces 110 surrounding the tendon 300 are fastened by a fastening ring 120 inserted into a groove formed in an upper portion of the anchoring wedge.

The wedge pieces 110 are typically formed of steel pieces and have a width increasing in a direction from a lower end (a left side in FIG. 2B) thereof toward an upper end (a right side in FIG. 2B) thereof to correspond to the tapered anchorage hole 441 of the head part 440, and the plurality of wedge pieces 110 are in contact with each other laterally and installed so that the fastening ring 120 surrounds the upper portion of the anchoring wedge to allow the tendon 330 to be in contact with an inner side of the wedge pieces 110.

Figure 2C:
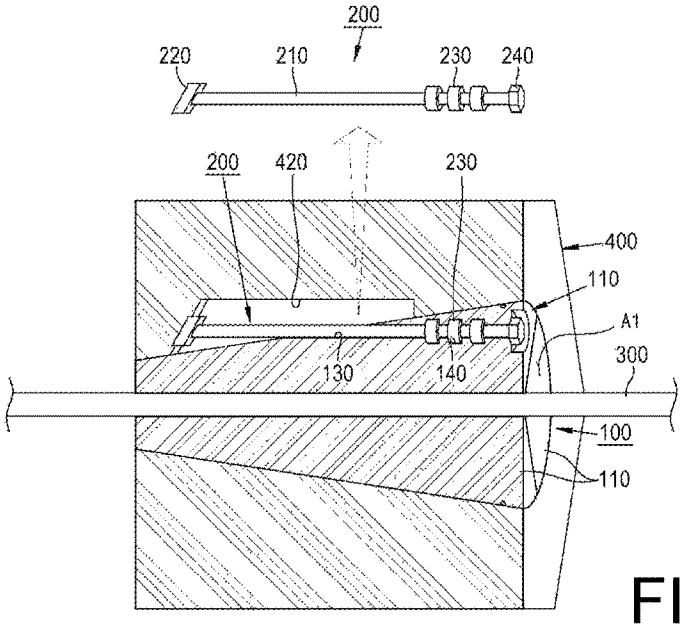
Figure 2E:
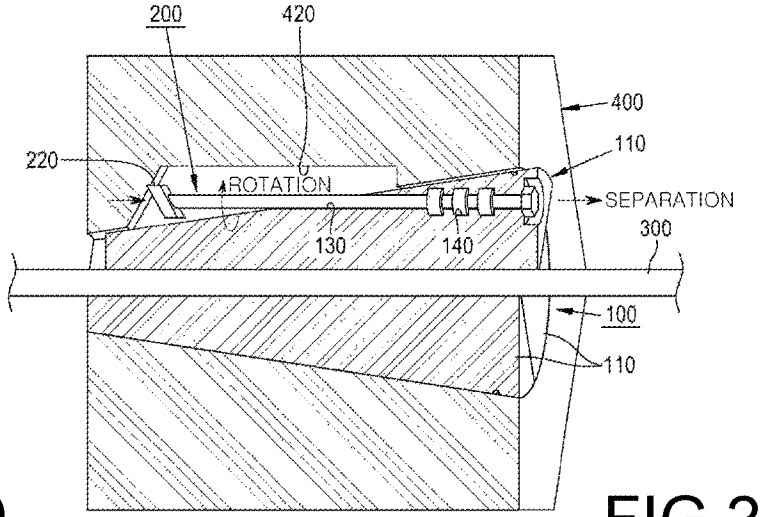
Figure 2D:
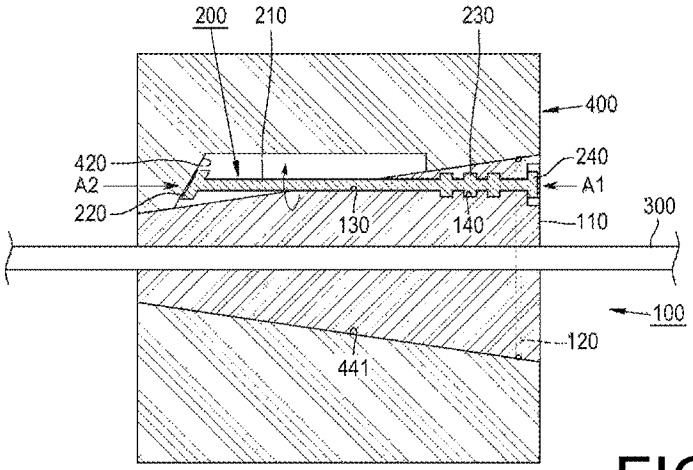

Further, as shown in FIGS. 2C, 2D and 2E, it may be confirmed that the anchoring wedge 100 has a bolt hole 130, and a case in which the bolt hole 130 is formed in the wedge piece 110 will be described below.

It may be confirmed that the bolt hole 130 is formed as a horizontal hole that extends to be externally exposed from an upper end portion A1 of the wedge piece 110 through the inside of the wedge piece 110, and particularly, includes a fastening part 140 formed as a screw groove.

The fastening part 140 allows the separable bolt 200, which will be described below, to be rotatably fastened to the bolt hole 130 and not come out of the bolt hole 130. Therefore, the fastening part 140 may be formed as a female screw part.

Further, the upper end of the bolt hole 130 extends to accommodate a rotating nut 240 of the separable bolt 200 to be described below.

The tapered anchorage hole 441, which is a member in which the anchoring wedge 100 is anchored, is formed in the head part 440 of the anchoring unit 400, and the anchoring wedge 100 formed to surround the tendon 300 is inserted into and anchored in the anchorage hole 441.

As shown in FIGS. 2B, 2C, 2D and 2E, it may be confirmed that the head part 440 of the anchoring unit 400 further includes an internal groove 420 that communicates with the anchorage hole 441.

Therefore, the bolt hole 130 formed in the wedge pieces 110 extends to the internal groove 420, and it may be confirmed that a front end part 220 of the separable bolt 200 inserted into the bolt hole 130 is exposed to the internal groove 420.

That is, the internal groove 420 has the form of a groove that is cut out of an inner surface of the anchorage hole 441 and extends in a length direction of the head part 440 of the anchoring unit 400. In a state in which the front end part 220 of the separable bolt 200 is in contact with an inclined inner surface A2 of the internal groove 420 and supported, when the separable bolt 200 is rotated, a fastener 230 of the separable bolt 200 screw-coupled to the fastening part 140 is screw-moved (right side of FIGS. 2C to 2E), and the wedge pieces 110 are separated from the anchorage hole 441.

As shown in FIGS. 2B, 2C, 2D and 2E, the separable bolt 200, which is a rod-shaped member, serves to separate the anchoring wedge 100 from the head part 440 of the anchoring unit 400 and includes a bolt-body part 210, a front end part 220, a fastener 230, and a rotating nut 240.

As shown in FIGS. 2B, 2C, 2D and 2E, the bolt-body part 210 has a diameter to be inserted into the bolt hole 130 formed in the wedge pieces 110 forming the anchoring wedge 100, and a portion of the bolt-body part 210 at which the front end part 220 is formed is exposed to an internal groove 420.

Next, as shown in FIGS. 2B, 2C, 2D and 2E, the front end part 220 may be assembled to one front end portion of the bolt-body part 210 as an expansion flange and has an increased area in which a front surface is in contact with the inclined inner surface of the internal groove 420 to serve to support rotation movement of the separable bolt 200.

Next, as shown in FIGS. 2B, 2C, 2D and 2E, the fastener 230 is formed as, for example, a male screw part fastened to the fastening part 140 formed in the wedge pieces 110 and is fastened to the fastening part 140, which is the female screw part, so that a screw movement in which the anchoring wedge 100 is separated from the anchorage hole 441 is performed. In this case, since only release of the anchored tendon 300 is required, an excessive force is not required.

Next, as shown in FIGS. 2B, 2C, 2D and 2E, the rotating nut 240 is integrally formed on a head part of the bolt-body part 210 in an assembling manner and the like and serves to fix the head part of the bolt-body part 210 to the wedge pieces 110 at an expanding upper end of the bolt hole 130 formed in the wedge piece 110, and when the rotating nut 240 rotates a rotating device (not shown), the separable bolt 200 rotates to have a rotating force. Further, it may be confirmed that the rotating nut 240 is accommodated in a groove formed in the upper end portion A1 of the wedge piece 110.

As shown in FIGS. 2A and 2B, the tendon 300 may refer to a prestressed concrete (PC) steel strand, a wire rope, and the like, and when a portion surrounding the anchoring wedge 100 is anchored to the head part 440 of the anchoring unit 400, a tensioning force is introduced, and thus a prestress is introduced to the anchoring unit 400 in which the tendon 300 is installed.

In an operation of the anchoring wedge 100 with the separable bolt of the present invention, first, as shown in FIGS. 2C to 2E, an operation in which the separable bolt 200 separates the anchoring wedge 100 anchored in the head part of the anchoring unit 400 while the fastener 230 of the separable bolt 200 is fastened to the fastening part 140 formed in the anchoring wedge 100 in a rotatable manner (a female and male screw manner) is as follows.

First, as shown in FIGS. 2C to 2E, it may be confirmed that the tendon 300 is anchored in the anchorage hole 441 formed in the head part 440 of the anchoring unit 400 by the anchoring wedge 100.

In this case, since the fastener 230 of the separable bolt 200 is rotatably fastened to the fastening part 140 of the bolt hole 130 formed in the wedge piece 110 of the anchoring wedge 100 and inserted thereinto, the bolt-body part 210 is inserted into the bolt hole 130 and extended.

Therefore, the front end part 220 having an inclined flange shape is formed on the front end portion of the separable bolt 200, and the front end part 220 is set to be in contact with an inner surface of the internal groove 420.

Further, it may be confirmed that the rotating nut 240 is integrally formed on the head part of the separable bolt 200 and fastened to the expanding upper surface of the bolt hole 130 formed in the wedge piece 110 of the anchoring wedge 100. Therefore, when the rotating nut 240 rotates, the separable bolt 200 rotates, and the fastener 230 fastened to the fastening part 140 rotates, and thus the separable bolt 200 moves in the bolt hole 130 in a screwing manner.

Therefore, as shown in FIGS. 2C to 2E, when the separable bolt 200 rotates in a reverse direction while the front end part 220 of the separable bolt 200 is in contact with the internal groove 420 of the head part 440 of the anchoring unit 400, the front end part 220 is spaced apart from the internal groove 420, the fastener 230 moves along the fastening part 140 in a screwing manner, and the anchoring wedge 100 is simply separated from the anchorage hole 441 of the head part 440 of the anchoring unit 400.

Therefore, when a worker only has a rotating device that rotates the rotating nut 240, a separate operation and a space for tensing a tendon are not required, and thus the tendon can be prevented from bouncing.

[Method of Constructing Hollow Composite Beam Using a Dual-Web of the Present Invention]

FIG. 3 is a view illustrating a fire resistant construction method of a composite floor system 600 as a construction method using a hollow composite beam 500 using a tendon anchoring part 540 having a separable bolt of the present invention.

The fire resistant construction method allows a hollow composite beam 500 to have a strength that maximally delays degradation of the composite floor system 600 when a fire occurs by allowing a tendon 300 to introduce a prestress to the hollow composite beam 500 using a separable bolt 200, an anchoring unit 400, and a tendon anchoring part 540.

Therefore, as shown in FIG. 3, the hollow composite beam 500 is constructed between column structures (not shown) of a building, and two end portions of the hollow composite beam 500 may be fixed to a space between the column structures.

As shown in FIGS. 2A and 3, the hollow composite beam 500 includes a top flange 520, a bottom flange 510, and a dual-web 530 and allows the tendon 300 to introduce a prestress to the hollow composite beam 500 using a tendon anchoring part 540, the anchoring unit 400, and a separable bolt 200.

Specifically, the anchoring wedge 100 having the separable bolt 200 is installed in the anchoring unit 400 in a form in which the tendon 300 is anchored, and the anchoring unit 400 includes an anchoring plate 410, a bolt part 430, and a head part 440 integrating with each other.

Therefore, it may be confirmed that a fixing nut 450 that allows the bolt part 430 of the anchoring unit 400 to be fixedly fastened to the head part 440 may be further included.

As shown in FIG. 2B, it may be confirmed that an anchorage hole 441 passes through a central portion of the head part 440 of the anchoring unit 400 and is formed in a tapered manner, wherein the head part 440 includes the bolt part 430. Further, an internal groove 420 communicates with the anchorage hole 441.

Further, it may be confirmed that the anchorage hole 441 continuously extends to an internal hole of the bolt part 430 integrated with the hexagonal head part 440.

The tendon 300 passes through the head part 440 having the bolt part 430, and the anchoring wedge 100 having the separable bolt 200 is initially anchored in the tendon 300.

That is, the anchoring wedge 100 is set so that a plurality of wedge pieces 110 are fastened by a fastening ring to surround the tendon 300. Further, the separable bolt 200 is inserted into the bolt hole 130 of the wedge pieces 110, and the fastener 230 of the separable bolt 200 is fastened to the fastening part 140, and thus the rotating nut 240 is accommodated in an expanding upper surface of the wedge pieces 110.

As shown in FIG. 2B, the bolt part 430 is fixedly installed in the fastening hole 411 of one surface of the anchoring plate 410 by the fixing nut 450.

Next, the tendon 300 is tensed, the anchoring wedge 100 having the separable bolt 200 is inserted into the anchorage hole 441 of the head part 440 of the anchoring unit 400, and the front end part 220 of the separable bolt 200 is set in the internal groove 420 of the anchoring unit 400.

Therefore, when a tensioning force introduced to the tendon 300 is released, the separable bolt 200 is anchored to the anchoring unit 400 as a reaction force.

In this case, as shown in FIGS. 2C to 2E, even when separation of the anchoring wedge 100 from the anchoring unit 400 is required, the rotating nut 240 formed in the head part of the separable bolt 200 rotates so that the front end portion of the separable bolt 200 is in contact with an inclined inner surface to be supported. In this case, when the separable bolt 200 rotates additionally, rotation is blocked, and the anchoring wedge 100 moves from the anchorage hole 441 of the anchoring unit 400 to be separated therefrom.

Next, to construct a composite floor system of the present invention, a plurality of deck plates D are installed on the bottom flange 510 of the hollow composite beam 500, slab reinforcement bars are arranged, and slab concrete is poured thereon.

Therefore, the hollow composite beam 500 and the slab reinforcement bars on the deck plate D are constructed to integrate with each other and be combined.

The hollow composite beam using a dual-web according to the present invention can more efficiently use an internal space using a dual-web having a width gradually increasing in a direction downward from a top flange, and the bottom flange allow deck plates to supported on upper surfaces of two ends thereof.

Further, a tendon anchoring part having a separable bolt is installed in an internal space formed by the dual-web to be fastened to the dual-web, and thus a prestress is stably and efficiently introduced, and thus fire resistance performance of a composite floor system can be secured.

Further, according to the hollow composite beam using a dual-web and a construction method thereof according to the present invention, the hollow composite beam using a dual-web includes a separable bolt installed in an anchoring wedge and allows the anchoring wedge to be separated from an anchoring unit just by rotating the separable bolt, and thus the anchoring wedge can be more quickly and efficiently used.

Therefore, a tensioning force caused by a tendon is partially adjusted so that a prestress introduced to the structure is more precisely adjusted, and thus a steel beam can be very effectively managed.

Further, conventionally, a complicated device should be installed or an auxiliary disassembling device should be used to introduce a prestress using a tendon and disassemble an anchoring unit. However, a wedge can be pulled out by a rotating force caused by a simple tool (a rotating device) to which a separable bolt is applied, and durability can be secured due to a simple configuration.

Further, when a prestress is excessively introduced by a tendon, the tendon is easily re-tensed after release of tensioning, and since a post-tensioned member necessarily requires release of tensioning, post-tensioning can be applied through simple and safe release without affecting a structural member as a member to be anchored.

The above description of the present invention is only exemplary, and it should be understood by those skilled in the art that the invention may be performed in other concrete forms without changing the technological scope and essential features. Therefore, the above-described embodiments should be considered as only examples in all aspects and not for purposes of limitation. For example, each component described as a single type may be realized in a distributed manner, and similarly, components that are described as being distributed may be realized in a coupled manner.

The scope of the present invention is defined not by the detailed description but by the appended claims and encompasses all modifications or alterations derived from meanings, the scope, and equivalents of the appended claims.

What is claimed is:

1. A hollow composite beam using a dual-web, comprising:

a dual-web formed by two inclined plates to form an internal space between a lower surface of a top flange of a steel beam and an upper surface of a bottom flange of the steel beam, wherein the two inclined plates continuously extend in a length direction of the hollow composite beam;

an anchoring unit configured to tense two end portions of a tendon, which is disposed to extend in the internal space in the length direction of the hollow composite beam, using the two inclined plates and anchor the two end portions of the tendon using a tendon anchoring part, wherein the anchoring unit comprises an internal groove formed to communicate with an anchorage hole, and wherein an anchoring wedge is anchored in the anchorage hole and comprises a bolt hole that is a horizontal hole extending to be externally exposed through an upper surface and an inside of the anchoring wedge and a fastening part formed in a middle of the bolt hole; and a separable bolt having a bolt-body part inserted into the bolt hole formed in the anchoring wedge so that a portion at which a front end part is formed is exposed to the internal groove, wherein the bolt-body part is a rod member having a fastener formed in a middle of the rod member and fastened with the fastening part of the anchoring wedge to move in a screwing manner while rotating, wherein the separable bolt inserted into the anchoring wedge rotates to allow the anchoring wedge to be separable from the anchorage hole.

2. The hollow composite beam of claim 1, wherein the tendon anchoring part comprises:

two anchoring vertical plates that extend downward from a central lower surface of the top flange and are spaced apart from each other so that two end portions of the two anchoring vertical plates extend to end surfaces of the two inclined plates and are hung; and a tendon supporting plate formed on a lower portion between the two anchoring vertical plates so that the tendon does not come out downward from between the two anchoring vertical plates, wherein the tendon is positioned between the two anchoring vertical plates.

3. The hollow composite beam of claim 2, wherein the tendon anchoring part further comprises an end surface-transverse fixing element having a central portion fastened with the two anchoring vertical plates between which the tendon is positioned and the two end portions are also fastened with the two inclined plates so that the tendon is stably settable.

4. The hollow composite beam of claim 1, wherein the anchoring unit comprises:

a head part formed such that the anchorage hole is tapered and passes through the head part;

a bolt part that is inserted into a through hole formed in an object to be anchored and is integrated with the head part; and a fixing nut allowing the bolt part to be fixedly fastened to the object to be anchored, wherein the tendon is disposed to pass through the anchorage hole and the bolt part, and the anchoring wedge is anchored in the anchorage hole.

5. The hollow composite beam of claim 4, wherein the anchoring wedge comprises a plurality of wedge pieces disposed to surround the tendon and the bolt hole formed in one of the wedge pieces as the horizontal hole, and the separable bolt is inserted into the bolt hole formed in the one of the wedge pieces so that a front end part is exposed to the internal groove.

6. The hollow composite beam of claim 5, wherein the separable bolt comprises:

a bolt-body part inserted into the bolt hole formed in the anchoring wedge as a rod member so that a portion at which the front end part is formed is exposed to the internal groove;

the front end part which is assembled to a front end portion of the bolt-body part as an expanding flange and allows an area in which a front surface of the front end part is in contact with an inclined internal surface of the internal groove to increase so as to support rotation movement of the separable bolt; and a fastener that rotates while being fastened to the fastening part of the anchoring wedge to move the anchoring wedge in a screwing manner so that the anchoring wedge is separated from the anchorage hole.

7. The hollow composite beam of claim 6, wherein, in the separable bolt, a rotating nut that allows a head part of the bolt-body part to be fixed to the anchoring wedge is integrally assembled to the head part of the bolt-body part, wherein the rotating nut is accommodated in a groove foil led in an upper end portion of the one of the wedge pieces, and the anchoring wedge allows the tendon to be anchored in the anchorage hole, wherein the tendon comprises a wire rope.

8. A method of constructing a hollow composite beam using a dual-web, comprising:

constructing a hollow composite beam which comprises a dual-web formed by two inclined plates to form an internal space between a lower surface of a top flange of a steel beam and an upper surface of a bottom flange of the steel beam, wherein the two inclined plates continuously extend in a length direction of the hollow composite beam, and an anchoring unit configured to tense two end portions of a tendon, which is disposed to extend in the internal space in the length direction of the hollow composite beam, using the two inclined plates and anchor the two end portions of the tendon using a tendon anchoring part; and installing a plurality of deck plates on the bottom flange of the hollow composite beam, arranging slab reinforcement bars, and pouring slab concrete on the plurality of deck plates to construct a composite floor system, wherein the anchoring unit comprises an internal groove formed to communicate with an anchorage hole, and wherein an anchoring wedge is anchored in the anchorage hole and comprises a bolt hole that is a horizontal hole extending to be externally exposed through an upper surface and an inside of the anchoring wedge and a fastening part formed in a middle of the bolt hole, wherein the hollow composite beam further comprises a separable bolt having a bolt-body part inserted into the bolt hole formed in the anchoring wedge so that a portion at which a front end part is formed is exposed to the internal groove, wherein the bolt-body part is a rod member having a fastener formed in a middle of the rod member and fastened with the fastening part of the anchoring wedge to move in a screwing manner while rotating, wherein the separable bolt inserted into the anchoring wedge rotates to allow the anchoring wedge to be separable from the anchorage hole.

* * * * *